United States Patent [19]

Burns et al.

[11] Patent Number: 4,530,559

[45] Date of Patent: Jul. 23, 1985

[54] LOCKING MEANS FOR A PLUG AND RECEPTACLE CONNECTOR

[75] Inventors: Edgar Burns, Los Angeles; James W. Johnson, No. Hollywood; Adele R. Kimbrough, Los Angeles, all of Calif.

[73] Assignee: Automation Industries, Inc., Greenwich, Conn.

[21] Appl. No.: 546,973

[22] Filed: Oct. 31, 1983

[51] Int. Cl.[3] ..... H01R 13/625

[52] U.S. Cl. ..... 339/90 R; 339/DIG. 2

[58] Field of Search ..... 339/89 R, 89 C, 89 M, 339/90 R, 90 C, DIG. 2, 186 R, 186 M

[56] References Cited

U.S. PATENT DOCUMENTS 4,066,315 1/1978 Arneson ..... 339/89 M

FOREIGN PATENT DOCUMENTS 1389839 1/1965 France ..... 339/89 M

*Primary Examiner*—John McQuade

*Attorney, Agent, or Firm*—Thomas L. Flattery

[57] ABSTRACT

A spring-loaded pin maintains the plug shell and coupling ring of a plug and receptacle electrical in predetermined relation lockingly aligning internal keyways when the connector parts are unmated. When a receptacle having an appropriately coded set of peripheral keys is received within the plug shell, certain of the keys act to release the locked alignment of coupling ring to plug shell enabling the coupling ring to be rotated and drive the plug and receptacle together into mated relation.

4 Claims, 9 Drawing Figures

LOCKING MEANS FOR A PLUG AND RECEPTACLE CONNECTOR

The present invention relates generally to a plug and receptacle electrical connector, and more particularly to a locking means for securing certain of the connector parts in a predetermined relation until proper connection mating is assured.

BACKGROUND AND FIELD OF THE INVENTION

A plug and receptacle electrical connector has parts releasably fitting together for selectively interconnecting one or more electrical cable wires together. A well-received form of plug and receptacle connector includes a coupling ring or housing which is mounted on a plug electrical part and rotatable to drive the plug and receptacle together or apart, according to the direction of rotation.

U.S. Pat. No. 4,066,315 "Electrical Connector with Arcuate Detent Means" issued Jan. 3, 1978 to Hal Arneson discloses a detent and locking means which maintains the connector coupling ring and plug at the desired locked relation when the plug and receptacle are unmated or separated. Although the locking means disclosed in this patent accomplishes the desired locking arrangement, it is a relatively complex and expensive item to manufacture.

SUMMARY

In the practice of the present invention there is provided a coupling ring or housing which is received about a cylindrical plug shell, the inner wall surfaces of the coupling ring including keyways (or optional keys) which are of a coded arrangement in order to insure proper mating with similarly coded keys on the receptacle. The inner wall surface of the coupling ring includes an opening within which a coil spring is received that urges a plunger outwardly of the opening and toward the facing outer wall of the plug. An opening formed in the plug shell wall includes a ball slidingly received therein, the lower or inner surface of the plug shell opening being stepped to prevent the ball from leaving the opening, but allowing a portion of the ball to extend beyond the inner surface of the plug wall. The plunger is urged by the spring outwardly from the opening in the coupling ring, and this opening along with the plug shell opening are so arranged that when the openings are aligned the plunger moves a short distance into the opening of the plug shell thereby locking relative movement of the coupling ring with respect to the plug shell. The keyways of the coupling ring are thus locked at a prescribed arrangement with respect to the plug shell so that the receptacle and plug contacts can properly mate with one another on joining of the plug and receptacle.

When the appropriate receptacle is inserted into the plug cavity, the outer surface of the receptacle engages that portion of the ball which extends from the plug opening moving it radially outwardly which, in turn, moves the plunger against the spring and releases the locking arrangement between the coupling ring and plug. The coupling ring may now be rotated relative to the plug shell to drive the plug and receptacle together. Also, as the coupling ring is rotated in a direction to release the receptacle from the plug, on the receptacle being finally released, the ball moves outwardly of its opening and the plunger again locks the coupling ring and plug shell against relative movement.

DESCRIPTION OF A PREFERRED EMBODIMENT

Figure 1:
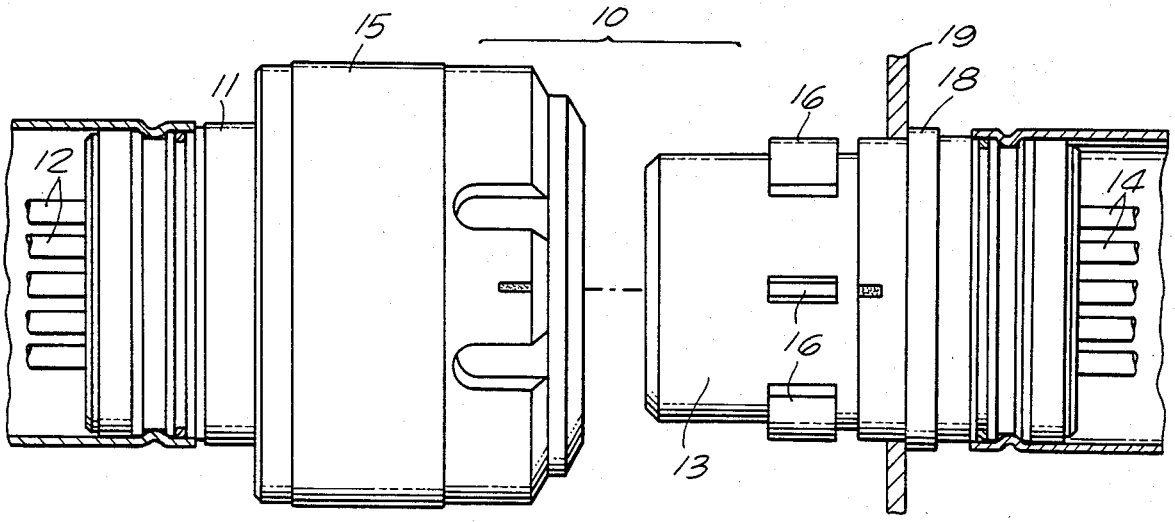
FIG. 1 is a side elevational, partially sectional view of a plug and receptacle connector shown disconnected.
Figure 2:
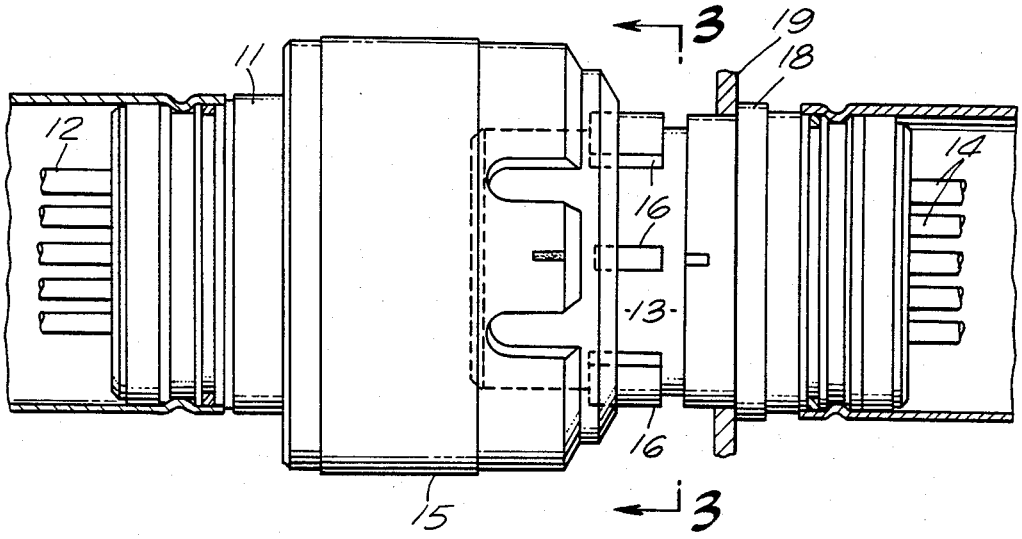
FIG. 2 is a side elevational, partially sectional view of the electrical connector of FIG. 1 showing the parts partially mated.
Figure 3:
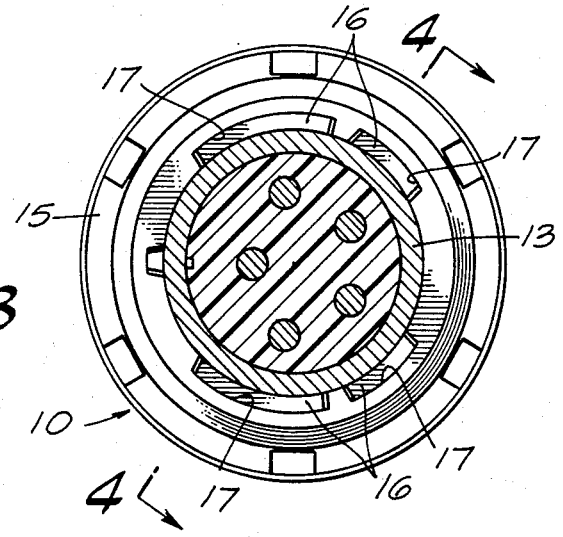
FIG. 3 is an end elevational, sectional view taken along the line 3—3 of FIG. 2.

Attention is now directed to the drawings and particularly FIG. 1 in which an electrical connector with which the locking means to be described is advantageously employed is enumerated generally as at 10. This connector typically includes a plug shell 11 which has internal contacts (e.g., pin contacts) interconnected to a set of cable wires 12. A receptacle 13 has a further set of contacts (e.g., socket contacts) which are interconnected with the plug contacts on the receptacle being received within the plug and in that way to connect the cable wires 12 to a further set of cable wires 14. A hollow metal shell termed a coupling ring or coupling housing 15 is received on the plug shell and rotatable for mating or unmating the plug and receptacle depending on the direction of rotation of the coupling ring. Also, in order to insure integrity of interconnection between a given plug and receptacle, a set of keys 16 on the receptacle outer surface in a coded arrangement provide appropriate interfitting with similarly coded keyways 17 on the inner surface of the open end of the coupling ring 15 and plug shell 11 (FIG. 3). It is necessary, therefore, that the coupling ring 15 and associated plug shell 11 be maintained in correct alignment when the connector parts are in the unmated position since if they are oriented to a nonaligned position then the receptacle 13 cannot be received within the plug shell and coupling housing.

Figure 4:
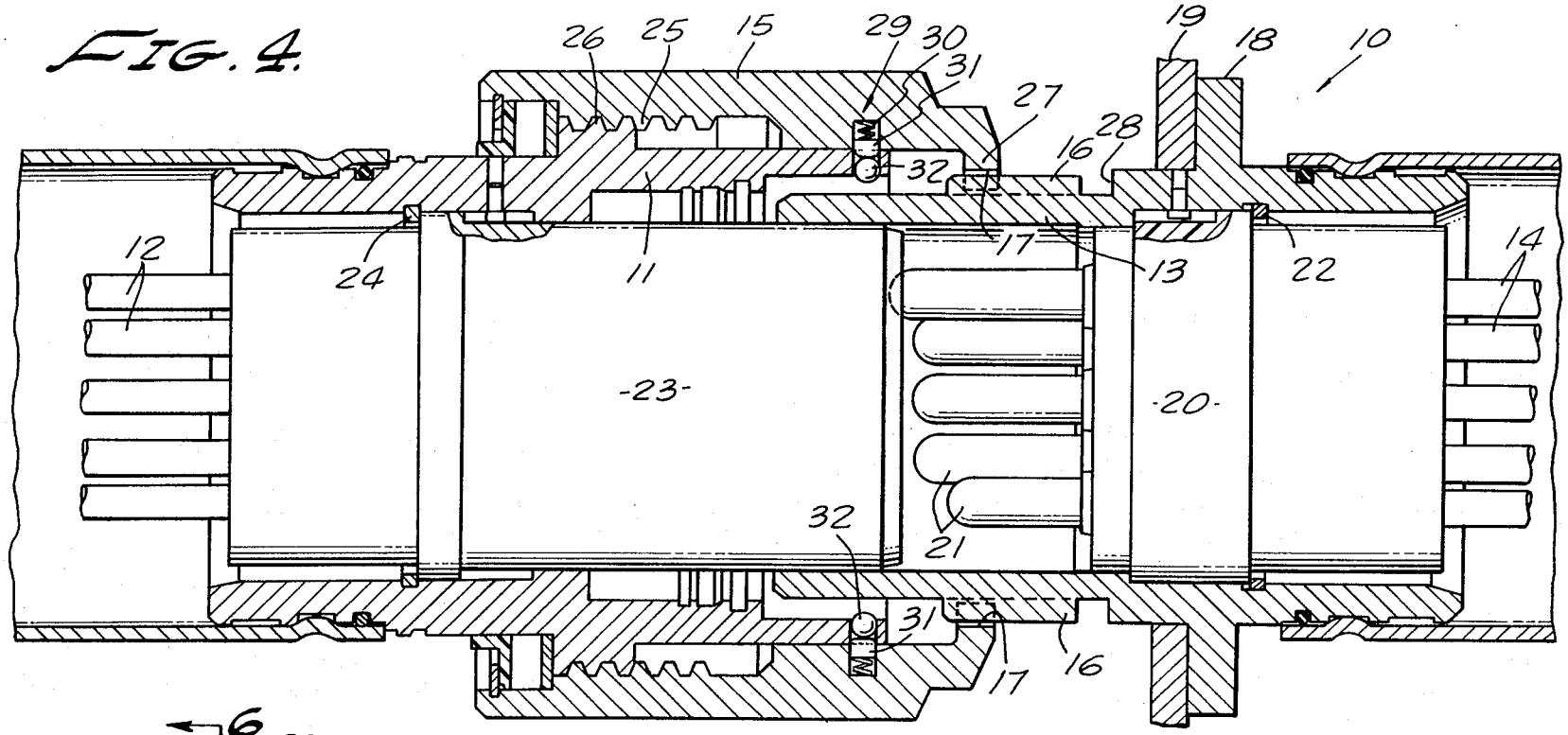
FIG. 4 is a side elevational, sectional view taken along the line 4—4 of FIG. 3 showing the coupling ring and plug shell in the ready-to-mate position.

Turning now to FIG. 4 showing the plug and receptacle in about-to-be-mated condition, the receptacle 13 is seen to consist generally of a hollow, cylindrical metal body having a relatively large diametral part that extends outwardly from a mated connector and a smaller diametral part received within the plug 11 when the connector parts are mated. Typically, an enlarged flange 18 extends circumferentially about the receptacle for external mounting to a support wall 19, for example.

The smaller diametral end of the receptacle has, as has already been noted, a plurality of keys 16 in a coded arrangement corresponding to a similar coded set of keyways 17 on the coupling ring 15 and plug shell 11 thereby insuring that only a proper receptacle can be mated with the plug.

An insulative insert 20 is secured within the receptacle and has a number of passages extending therethrough within which electrical contacts, such as pin contacts 21 are located. A retainer ring 22 holds the insert 20 and pin contacts firmly within the receptacle, with the pin contacts oriented parallel to the receptacle cylindrical axis.

The plug shell 11 includes a hollow cylindrical metal body with an internal diameter at its open end which permits receipt of the small diametral end of the receptacle 13. An insulative insert 23 has a number of openings for accommodating an equal number of electrical contacts extending therethrough. In the present case, they will be socket contacts for receiving the receptacle pin contacts 21 therewithin. Accordingly, the openings and socket contacts are so located and arranged as to align precisely with the socket contacts 21. A retainer ring 24 serves to hold the insert and included socket contacts within the plug.

The coupling ring or housing 15 is a hollow cylindrical metal shell having a set of internal threads 25 which mesh with similar threads 26 on the outer surface of the plug. The open outer end of the coupling ring 15 has a radially inwardly directed flange 27 within which keyways 17 corresponding to the coded arrangement of the keys 16 on the receptacle peripheral surface are located. As already noted, this coded arrangement of keyways and keys insures that only coupling of the correct plug and receptacle can be produced and in this way mismatch is prevented. When the coupling ring is fully received on the receptacle with the flange located within a receiving circumferentially extending groove 28 as in FIG. 9 (and the locking means to be described released), rotation of the coupling ring causes the flange to be locked behind the keys 16 on the receptacle such that further rotation of the coupling ring drives the plug and receptacle together to effect mating.

The plug, receptacle and coupling ring construction and operation which have been described to this point are well known in the art and are only given as context within which the locking means to be described can be effectively employed.

Figure 5:
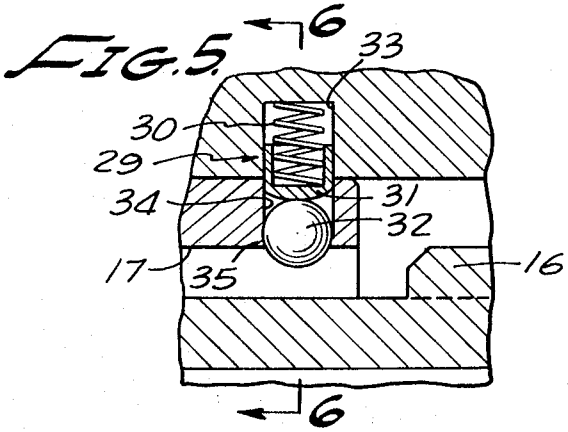
FIG. 5 is a side elevational, sectional enlarged view through the locking means.

For the immediately ensuing description of the locking means 29 between the coupling ring and plug shell, reference is made to both FIGS. 4 and 5. The locking means is seen to consist of a coil spring 30, a locking plunger 31 and a ball 32 all located within openings in the coupling ring and plug shell. More particularly, a generally cylindrical opening 33 in the inner wall of the coupling ring 15 can be aligned with a similarly shaped opening 34 which extends completely through the plug shell wall as shown in FIGS. 4 and 5. This alignment only occurs when the coupling ring and plug shell are so oriented relative to one another that the keyways in the flange 27 and in the plug shell will properly receive the keys on the receptacle to permit mating of the pin and socket contacts.

The coil spring 30 has one end bottoming in the opening 33 and the other end received within an opening in end of the plunger 31. The ball 32 is free to move along the opening 34 in the plug shell, however, the inner end of the opening 34 is stepped down as at 35 to prevent the ball from being able to move outwardly of 34 past 35.

When the openings 33 and 34 are aligned, the coil spring automatically moves the plunger 31 from the coupling ring opening as is shown in FIG. 5 pushing the ball 32 against the step-down portion 35 which locates the plunger simultaneously within both openings 32 and 34. At this time, the plunger locks the coupling ring and plug shell together so that relative movement between the two is prevented.

Figure 7:
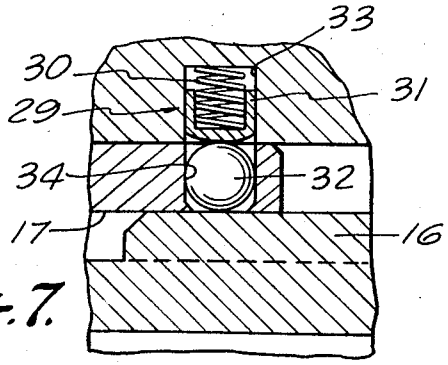
FIG. 7 is a view similar to FIG. 5 showing the locking means released by the receptacle during mating of the connector parts.
Figure 6:
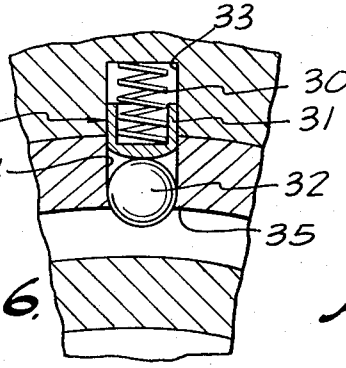
FIG. 6 is an end elevational, sectional view taken along the line 6—6 of FIG. 5 showing the locking means locked.

The locking means 29 is so located that when the receptacle is extended within the plug opening, certain of the keys 16 on the receptacle will engage that portion of the ball 32 which extends out of the plug shell surface. This engagement moves the ball further into the plug shell opening 34 which, in turn, moves the plunger 31 totally within the opening 33 thereby releasing the locking engagement of the plunger so that now, as can be seen best in FIGS. 7 and 9, the coupling ring may be rotated about the plug shell 11.

Figure 8:
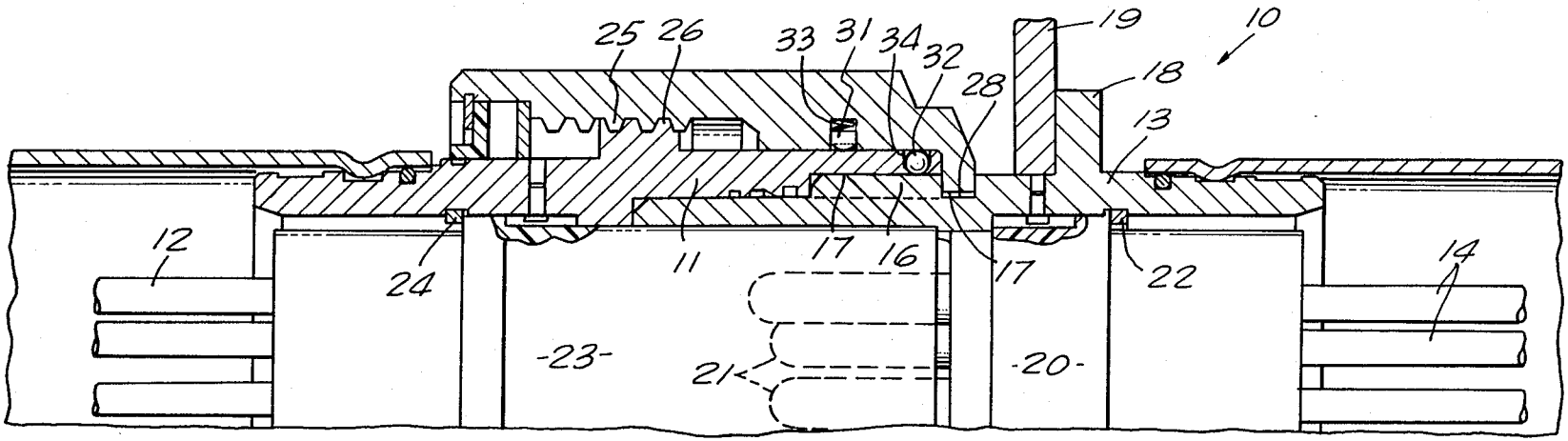
FIG. 8 is a side elevational, sectional view similar to FIG. 4 showing the locking means released and the connector parts fully mated.

Coupling ring rotation may now be continued drawing the receptacle and plug together into fully mating condition, as is shown in FIG. 8, at which time the opening 33 in the coupling ring is spaced longitudinally from the opening 34 in the plug shell. Also, of course, at this time the ball 32 is located completely within the plug opening 34 while the plunger and spring are similarly completely retained within the coupling ring.

Figure 9:
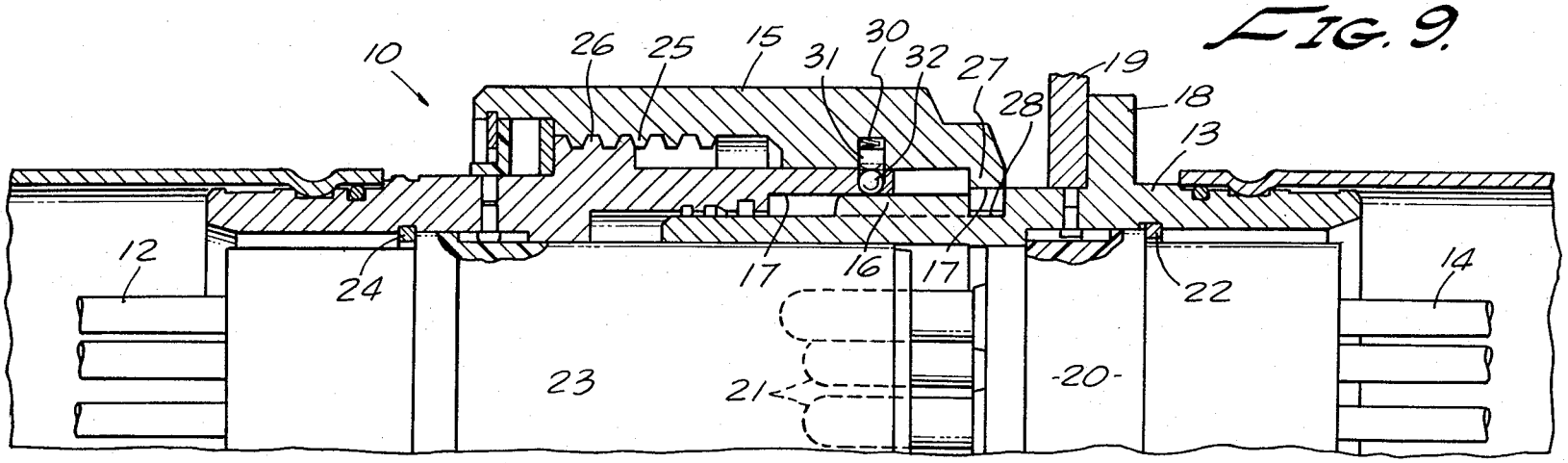
FIG. 9 is a view similar to FIG. 8 showing the connector parts partially unmated with the locking means aligned and prepared to lock upon removal of the receptacle from the plug.

To release the connector parts, the coupling ring 15 is rotated in the appropriate direction which drives the plug and receptacle from the fully mated position of FIG. 9. When the fully released position is reached (FIG. 9), the locking means openings 33 and 34 are aligned allowing the opening 30 to drive plunger 31 into 34 and in that way locking the plug shell and coupling ring against relative movement. Also, at this time since the receptacle keys are aligned with the plug and coupling ring keyways, the connector parts may be unmated by the simple application of oppositely directed longitudinal pulling forces on the plug and receptacle. As already indicated, with the connector parts separated from each other, the locking means 29 maintains the coupling ring and plug shell with their internal keyways so as to enable receipt of a correctly coded receptacle therewithin.

We claim:

1. In an electrical connector having a plug shell with a coupling ring rotatively mounted thereon and a receptacle for releasable receipt within an open end of the plug shell and coupling ring, internal walls defining the open end of the plug shell and coupling ring including a coded set of keyways alignable to receive the receptacle which has a similarly coded set of keys the improvement comprising:

openings in the coupling ring and plug shell which are aligned when the keys and keyways are aligned;

plunger means slidingly received within the coupling ring opening;

spring means within the coupling ring opening resiliently urging said plunger means toward the plug shell for sliding receipt within the plug shell opening on key and keyway alignment locking said coupling ring and plug shell against relative movement; and ball means in the plug shell opening continuously contacting the plunger means, said ball means having parts extending into the plug shell open end during key and keyway alignment which are engaged by the receptacle on connector mating to move the ball means fully within the plug shell opening and the plunger means out of the plug shell opening whereby the coupling ring and plug shell are movable relatively to each other.

2. An electrical connector as in claim 1, in which the opening in the plug shell and coupling ring are located within a keyway, and on mating of the receptacle to the plug shell a receptacle key engages the ball means parts extending into the plug shell open end and moves the ball means wholly into the plug shell opening.

3. An electrical connector as in claim 1, in which the plunger means is generally cylindrical and includes an opening in one end within which the spring means is received.

4. In a plug and receptacle electrical connector having a coupling ring rotatably mounted on a plug shell and cooperatively engageable means on said receptacle, coupling ring and plug shell for insuring only a proper plug and receptacle can mate, the improvement comprising:

locking means interrelating the plug shell and coupling ring for preventing relative rotative motion when the plug and receptacle are released; and means on said receptacle coacting with said locking means during mating of the plug and receptacle for releasing the locked relation between the plug shell and coupling ring;

said locking means including a plunger which extends between the coupling ring and plug shell in obstructing relation to relative movement therebetween when the plug and receptacle are separated, and when the receptacle mates with the plug said means on said receptacle moves the plunger out of obstructing relation to relative movement of the coupling ring and plug shell.

* * * * *